US006554586B1

(12) United States Patent
Lustwerk

(10) Patent No.: US 6,554,586 B1
(45) Date of Patent: Apr. 29, 2003

(54) SEALED MOTOR DRIVEN CENTRIFUGAL PRIMARY FLUID PUMP WITH SECONDARY FLUID FLOW FOR COOLING PRIMARY FLUID

(76) Inventor: Ferdinand Lustwerk, 304 Winthrop Ter., Bedford, MA (US) 01730

( * ) Notice: Subject to any disclaimer, the term of this patent is extended or adjusted under 35 U.S.C. 154(b) by 0 days.

(21) Appl. No.: 09/539,144

(22) Filed: Mar. 30, 2000

(51) Int. Cl.[7] ..... F04B 17/00; F04B 35/00
(52) U.S. Cl. ..... 417/366; 376/220
(58) Field of Search ..... 417/366, 369; 376/220; 378/129; 361/699

(56) References Cited

U.S. PATENT DOCUMENTS 4,231,718 A * 11/1980 Ruhl et al. ..... 417/366
5,332,369 A * 7/1994 Jensen ..... 417/369
5,420,897 A * 5/1995 Kasai et al. ..... 376/220
5,461,659 A * 10/1995 Siemers et al. ..... 378/129
5,890,880 A * 4/1999 Lustwerk ..... 417/366
6,102,909 A * 1/2000 Sloteman et al. ..... 417/366
6,208,512 B1 * 3/2001 Goldowsky et al. ..... 361/699

* cited by examiner

*Primary Examiner*—Teresa Walberg
*Assistant Examiner*—L Fastovsky
(74) *Attorney, Agent, or Firm*—Robert T Dunn, Esq.

(57) ABSTRACT

A sealed submersible electric motor driven centrifugal primary cooling fluid pump is entirely submersible in the electron beam tube cooling system of an X-Ray system incorporates a heat exchanger in the pump, wherein primary cooling fluid (oil or other high dielectric strength fluid) that is pumped in the sealed pump through an annular primary fluid passage therein is cooled by secondary cooling fluid flowing through an annular passage wrapped around the primary fluid annular passage over the length of the primary fluid annular passage, providing a compact unit of pump and heat exchanger.

26 Claims, 2 Drawing Sheets

VIEW B-B

VIEW D-D

VIEW A-A

VIEW C-C

SEALED MOTOR DRIVEN CENTRIFUGAL PRIMARY FLUID PUMP WITH SECONDARY FLUID FLOW FOR COOLING PRIMARY FLUID

BACKGROUND OF THE INVENTION

This invention relates to electric motor driven centrifugal fluid pumps and particularly to pumps of the sort that have no rotating axle or bearings that penetrate a wall of the pump housing and so the housing is completely sealed against any leakage of the fluid that is pumped and used to pump cooling oil in the cooling system of the electron beam tube of an X-Ray system.

Heretofore, magnetically driven centrifugal pumps that are completely sealed up and have no drive shaft or bearing opening through any wall of the housing of the pump have been provided for sealed cooling systems. Such pumps are often specified where, for any number of reasons, no fluid leakage from the pump can be. For example: the fluid may be very contaminating; or it may be poisonous or radioactive; or it may simply be a cooling fluid in a closed system that cannot tolerate any leaks.

An improved electric motor driven centrifugal fluid pump for this use has a sealed housing that contains the fluid, the motor and the pump is described in U.S. Pat. No. 5,890,880, issued Apr. 6, 1999, entitled "Sealed Motor Driven Centrifugal Pump", to Ferdinand Lustwerk, the inventor herein.

The pump described in U.S. Pat. No. 5,890,880 has the advantage that the motor is cooled by the pumped fluid by compelling the fluid to flow through parts of the motor and carry heat therefrom so that the motor can be operated at higher power without overheating.

It is an object of the present invention to provide such a fluid pump and electric drive motor in an assembly contained within a sealed housing as the electron beam tube cooling system of an X-Ray system, wherein a heat exchanger for cooling the pumped fluid is integrated with the assembly in a compact package.

It another object of the present invention to provide such a pump and electric drive motor assembly with a heat exchanger wherein means are provided for compelling some fluid flow around the electric motor in the sealed housing to reduce the static pressure on the pump rotor and so reduce the thrust load on the motor bearings.

SUMMARY OF THE INVENTION

According to the present invention, an electric motor driven centrifugal fluid pump includes a pump rotor and a pump drive motor in a sealed X-Ray tube cooling fluid system has a heat exchanger for the cooling fluid integrated therewith in a compact package. In the compact package, a sealed X-Ray tube cooling fluid (primary fluid) annular passage is provided around the motor and a secondary fluid annular passage is provided around the primary fluid annular passage to cool the primary fluid. The pump is then capable of providing the X-Ray tube cooling fluid (primary fluid) in a compact package that includes a heat exchanger without connections and hoses to a separate heat exchanger in the X-Ray system.

These and other objects and features of the present invention will be apparent to those skilled in the art from the following specific description of embodiments of the invention taken in conjunction with the drawings.

DESCRIPTION OF AN EMBODIMENT OF THE INVENTION

Figure 1:
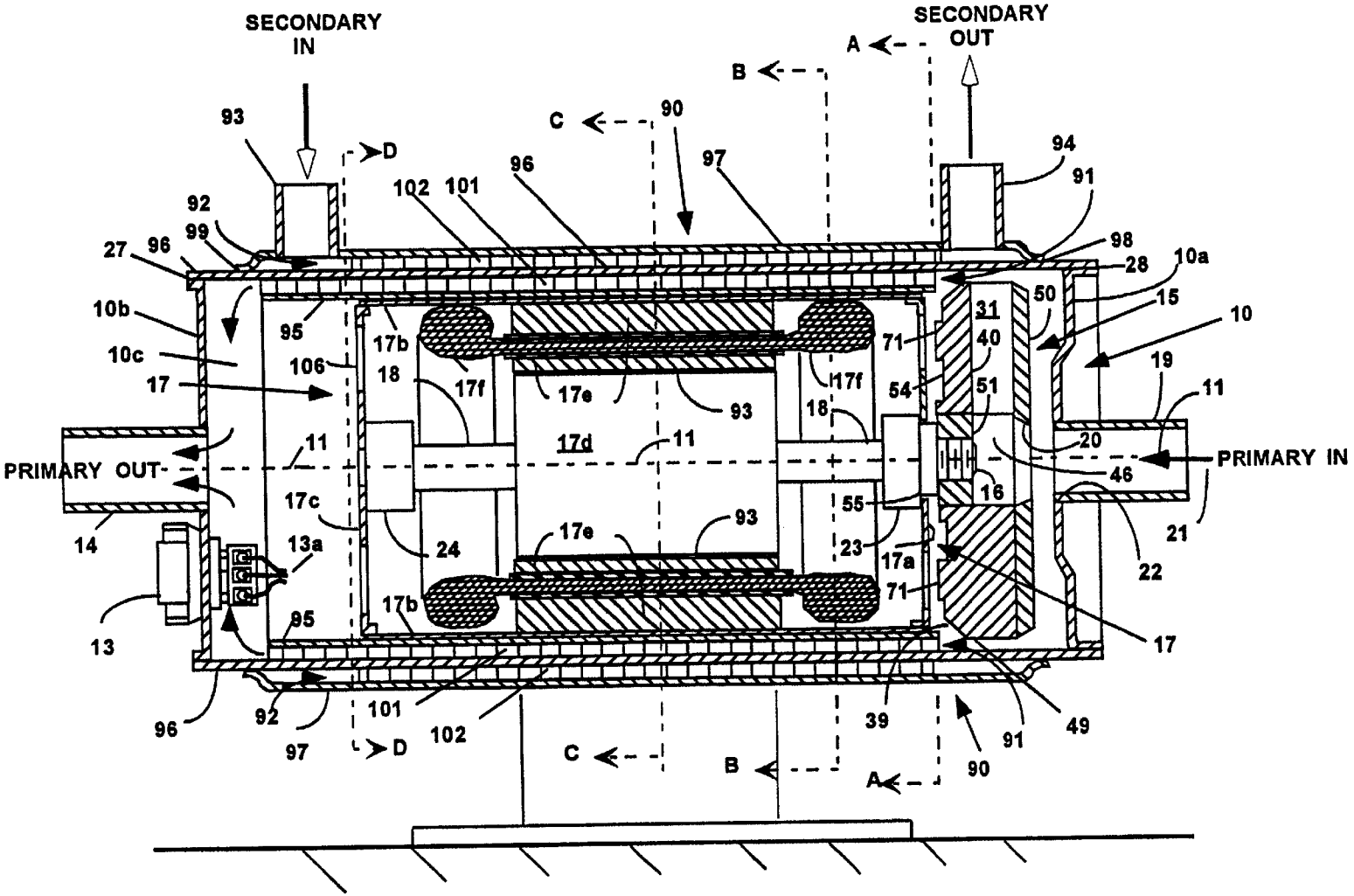
FIG. 1 is a schematic side cross section view of a sealed electric motor driven centrifugal fluid pump according to the present invention in which the pump rotor and the electric motor are totally contained within the sealed X-Ray tube cooling fluid (primary fluid) system which is enclosed by the sealed secondary fluid housing providing an integrated heat exchanger that cools the primary fluid suitably for cooling the X-Ray tube.
Figure 3:
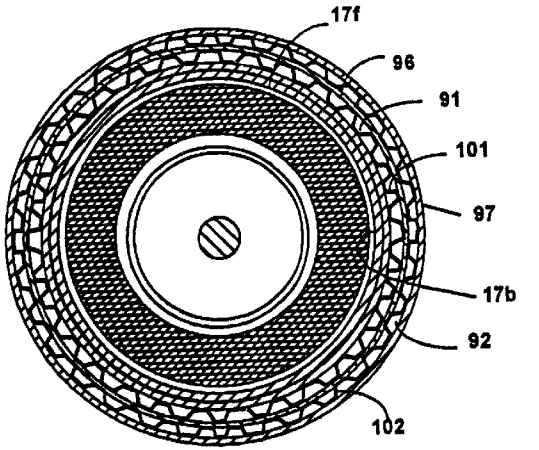
FIG. 3 is a cross section view B—B of the electric motor driven centrifugal fluid pump of FIG. 1 showing the primary fluid sealed housing containing the primary fluid annular passage and the integrated heat exchanger that includes the secondary fluid annular passage, and the motor stat or and stat or windings, the motor rotor and the motor drive shaft.
Figure 5:
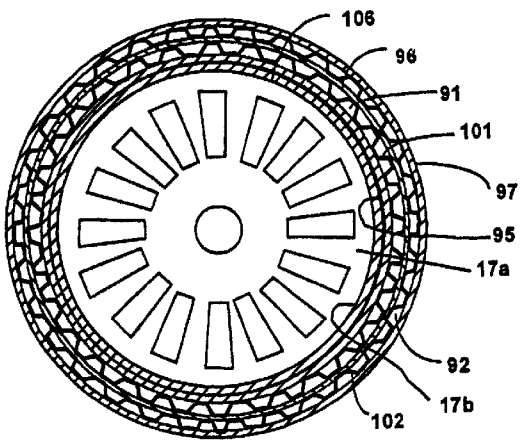
FIG. 5 is a cross section view D—D of the electric motor driven centrifugal fluid pump of FIG. 1 showing the primary fluid sealed housing containing the primary fluid annular passage and the integrated heat exchanger that includes the secondary fluid annular passage, and the motor back bearing support plate and the motor drive shaft.
Figure 2:
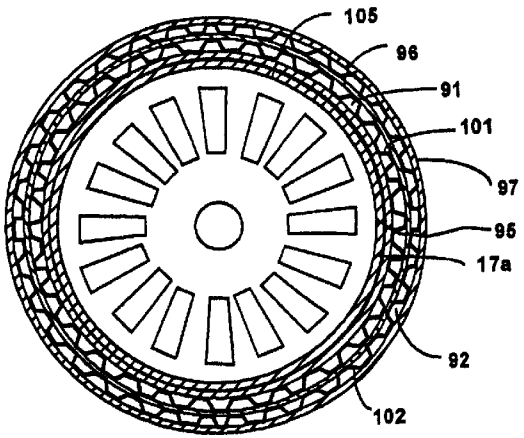
FIG. 2 is a cross section view A—A of the electric motor driven centrifugal fluid pump of FIG. 1 showing the primary fluid sealed housing containing the primary fluid annular passage and the integrated heat exchanger that includes the secondary fluid annular passage, and the motor bearing support disk and the motor drive shaft.
Figure 4:
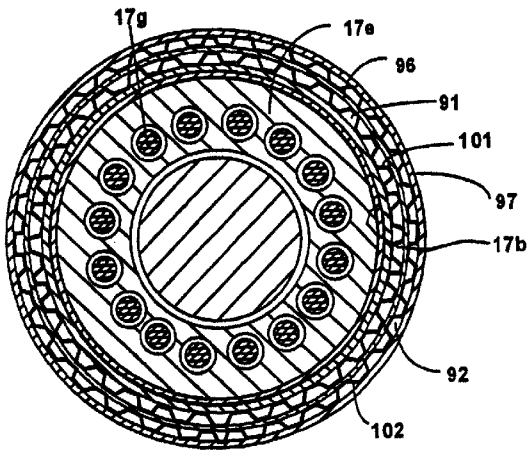
FIG. 4 is a cross section view C—C of the electric motor driven centrifugal fluid pump of FIG. 1 showing the primary fluid sealed housing containing the primary fluid annular passage and the integrated heat exchanger that includes the secondary fluid annular passage, and the motor stator and stator windings and the motor rotor.

A sealed submersible electric motor driven centrifugal primary cooling fluid pump and integrated heat exchanger according to the present invention is shown in the drawings, which illustrate the preferred embodiment of the pump. The motor and pump is entirely submersible in the electron beam tube cooling system of an X-Ray system wherein the primary cooling fluid is an oil or other fluid of high dielectric strength that is pumped in the sealed pump housing to cool the X-Ray system tube.

The motor assembly 17 is mounted inside the sealed primary fluid housing 10, which forms part of the integrated heat exchanger 90. The sealed primary fluid housing includes: primary fluid input 19 to the pump that is axial at the front center of the housing and primary fluid output 14 from the pump that is axial at the back center of the housing.

The preferred pump rotor 15 may be the same as the pump rotor described in the above mentioned U.S. Pat. No. 5,890,880, particularly with reference to FIGS. 4 to 7 therein and denoted therein. The pump rotor has a front face 40 at the primary fluid input and a back face 54 adjacent to the motor. The centrifugal pumping vanes such as 31 on the front face compel the primary fluid input flow to flow centrifugally outward, through a peripheral space and through the primary fluid annular passage 91 that encloses the motor from the front to the back of the motor to the primary fluid output 14.

An added advantage of the pump rotor is that the back face 54 of the rotor adjacent the motor has radial vanes that increase the velocity of the fluid flow between the front face 17*a* of the motor and the pump rotor so that the pressure of this fluid on the back face 54 of the rotor is reduced and so the pull of the pump rotor on the motor drive shaft 18 (the thrust load) is reduced. This reduced pressure is referred to herein as the static flow pressure which is less than the total pressure as the total pressure is the static pressure plus the velocity pressure.

Primary Fluid Sealed Pump Assembly

As shown schematically in FIG. 1, the pump primary fluid housing 10 and integrated heat exchanger 90 are essentially figures of revolution about the pump axis 11. The sealed primary fluid housing 10 is part of the integrated heat exchanger 90 and is formed in several parts: the front plate 10*a*, the inner cylindrical section 95, the middle cylinder section 96 and the back plate 10*b*, all sealed together and enclosing the motor assembly 17, the pump rotor 15 and providing primary fluid input 19 and primary fluid output 14. All of these parts of the housing 10 are also essentially figures of revolution about axis 11.

The motor assembly 17 inside housing 10 includes motor steel casing cylinder 17*b*, front bearing plate 17*a*, back or rear bearing plate 17*c*, motor rotor 17*d*, motor stator core 17*e*, motor stator windings 17*f*, motor stator windings plastic sleeves 17*g*, rotor drive shaft 18 and front and rear motor bearings 23 and 24, respectively.

Sealed housing cylinder 96 and inner cylinder 95 are concentric and spaced apart and define the primary fluid annular passage 91 from the front to the back of the pump. This passage is the principal flow path for primary fluid through the pump from input 19 to output 14.

Turning again to FIG. 1, which show some details of the motor and the pump rotor. There is embedded in the rotor base 49 at the center thereof hex nut 51 having threads to accommodate the threaded end 16 of the motor drive shaft 18, enabling attachment of the pump rotor to the motor drive shaft. The motor drives haft is a rigid extension of the motor axle 18 which is carried by front and back motor bearings 23 and 24, which are attached to the motor front and back plates 17*a* and 17*c*, respectively, which are welded to the steel motor cylindrical casing 17*b*. This attachment is done with suitable spacing between the rear face 54 of the pump rotor base 49 and the front face of the motor front plate 17*a*. The purposes of this spacing is to provide suitable clearance between the totaling pump rotor and the stationery front face of plate 17*a* of the motor and to define radial passages for centrifugal pumping of fluid between the motor and pump rotor, primarily to reduce thrust load on the motor.

At the back of the sealed housing cylinder 96, in the closed back space 10*c*, is mounted electrical connector 13 that is sealed thereto. This connector provides electrical connections to the motor electric power terminals 13*a* within the housing.

Heat Exchanger Secondary Cooling Fluid Annular Passage

The primary fluid flow through annular passage 91 is cooled by secondary cooling fluid flowing through an annular passage around the primary fluid annular passage over the length of the primary fluid annular passage. For this purpose secondary fluid annular passage 92 is provided enclosing the sealed primary fluid housing 10 and secondary fluid input 93 and secondary fluid output 94.

Secondary fluid passage 92 is provided by secondary fluid sealed housing cylinder 97 that is concentric with cylinder 96 and coextensive therewith. Cylinder 96 attaches to and seals to the periphery of front plate 10*a* at the front of the pump and attaches to and seals to the periphery of the back plate 10*b* at back of the pump. Secondary fluid input 93 is at the back of the pump and output 94 is at the front. Thus, the secondary cooling fluid flows through annular passage 92 from the back to the front, while the primary fluid flows through adjacent annular passage 91 from front to back.

Heat Exchanger Fin Stock In Annular Flow Passages

In order to guide fluid flow through the annular passages 91 and 92 and provide large surface area of thermally conductive material in the primary fluid path and in the secondary fluid path, a thermally conductive fin stock is loaded into each of the annular passages. There are many commercial sources of suitable fin stock, which may be in configurations referred to as: rectangular, triangular, wavy, perforated, louvered and offset strip fin. Of these, the offset strip fin is preferred.

The offset strip fin is formed of a thin sheet of copper that is worked into an offset fin shape of specific thickness and is provided in sheets of that thickness. For the uses herein, the offset strip fin sheet of specific thickness is cut to a piece for assembly into an annular passage. It is cut in length and width so that the width is equal to the circumference of the annular passage and the length is equal to the length of the annular passage containing the fin. As a result, such a piece of offset strip fin sheet can be wrapped around the inner cylinder that forms the annular passage and then the passage outer cylinder is inserted over it and compressed so that the sheet makes pressure contact with the inner and outer cylinders.

As shown in FIGS. 1 to 5, the offset strip fin 101 in the primary fluid annular passage 91 provides easy flow of the primary fluid from front to back of the pump parallel to axis 11. Also, the offset strip fin 102 in the secondary fluid annular passage 92 provides easy flow of the secondary fluid from back to front of the pump parallel to axis 11.

Pump Rotor

Within the motor assembly 17 is the pump rotor 15 carried on the motor drive shaft 16 which is securely attached thereto by the threaded end 16 of the drive shaft, which engages hex nut 51 that is fixedly embedded in the pump rotor base 49.

The axial fluid input passage 20 is provided by fluid input tube 19 that projects through an input hole 22 in the front housing plate 10*a* and is sealed to the housing plate at 22 by, for example, a weld seam.

As shown the above mentioned U.S. Pat. No. 5,890,880 and in FIG. 1, the pump rotor is provided with impeller ridges such as 71 on the rear face of the pump rotor base 49. These ridges with face 54 and the front face of the motor front plate 17*a* define radial fluid passages through which fluid is compelled to flow outward against the front face of plate 17*a* of the motor and then axially through the annular space 91, rearward, between the motor casing 17*e* and the inside wall of housing cylinder 10*b* through offset strip fin 101.

The pump rotor 15 is preferably made of metal or glass fiber filled lean and all parts are molded. The thermal expansion coefficient of this material is only a little greater than aluminum, which is the preferred material for the hex nut 51 that is embedded in the rotor. Thus, thermal expansion of the rotor will not leave the nut loose in the base of the rotor as would happen with other plastic materials (such as plain lean) that have a considerably higher coefficient of thermal expansion.

Motor Bearing Thrust Load Reduction

The forced flow of primary fluid through the motor at constant motor speed is a constant circulation flow as described herein above and carries heat from the motor. Without the pumping action of vanes 71 between the pump rotor and the motor face plate 17*a*, the static pressure against pump rotor 15 back face would be the same as the total pressure of the fluid entering annular passage 91. As a consequence, the thrust load on the motor bearings would be greatest. The effect of the flow induced by vanes 71 pumping action reduces the thrust load.

Operation And Use

In operation, the motor assembly 17 is energized through electric connector 13. As a rotor starts up rotation, primary fluid within the shrouded radial passages of the pump rotor immediately rotates with the rotor and is compelled by centrifugal force to flow to annular pump space 39 and into annular passage 91 to the back of the pump and out of output 14. The electron beam tube cooling system of the X-Ray system is a sealed fluid flow system through which the primary fluid flows from the pump output 14, through the tube cooling system thereof, to the pump input 19 and through the sealed housing 10 and is entirely filled with the primary fluid during operation.

The best known use of the motor and pump assembly described herein has been to pump cooling oil to X-Ray equipment to carry heat away from the equipment and dissipate the heat as described herein. In that use, the requirement for reliability of the motor-pump heat exchanger assembly is very high.

Mounting The Motor-Pump Assembly In The Housing

The heat exchanger assembly 90 providing the primary and secondary annular fluid passages loaded with off set strip fin sheets is fabricated of metal cylinders with the sheets of fins securely bonded to the cylinders that define the annular passages. As shown in the drawings, the heat exchanger assembly 90 includes: inner cylinder 95, middle cylinder 96, outer cylinder 97 that define primary and secondary fluid annular passages 91 and 92, respectively, and secondary fluid input and output 93 and 94, respectively. The outer cylinder 97 at each end of passage 92 is sealed to middle cylinder 96. For this purpose, the front and back ends of the outer cylinder are turned inward as shown and sealed to cylinder 96 by for example welding at 98 and 99.

Then the motor assembly 17 with the pump rotor 15 attached is inserted into the heat exchanger assembly 90 along the axis 11 to the position shown in the drawings and is secured to the inside of the heat exchanger at the inside of inner cylinder 95. At this assembly, wires 13*a* from the electrical connector 13 that feeds electric power through the back sealed enclosure plate 10*b* are connected to the motor. Then the back plate 10*b* and front plate 10*a* are attached and welded at 27 and 28, respectively, to complete the sealed enclosure 10.

What is claimed is:

1. A motor driven centrifugal primary fluid pump comprising, (a) a pump rotor, (b) a pump drive motor having a drive axis of rotation, (c) a primary fluid input to said pump from an outside source, (d) a primary fluid output from said pump to an outside utilization system, (e) means providing an annular passage around said motor for the flow of said primary fluid axially from said primary input to said primary output, (f) means providing a secondary fluid annular passage around said primary fluid annular passage to cool said primary fluid, (g) a secondary fluid input to said secondary fluid annular passage from a secondary fluid source and (h) a secondary fluid output from said secondary fluid annular passage to a secondary fluid reservoir.

2. A pump as in claim 1 wherein, (a) said pump drive motor has a front and a back and a motor drive shaft at said motor front defining said axis of rotation and (b) said pump rotor is attached to said motor drive shaft at said motor front.

3. A pump as in claim 2 wherein, (a) said primary fluid input is at said pump rotor and (b) said primary fluid output is at said motor back.

4. A pump as in claim 3 wherein, (a) said secondary fluid input is at said motor back and (d) said secondary fluid output is at said motor front.

5. A pump as in claim 1 wherein, (a) the axial direction of said secondary fluid flow through said secondary fluid annular passage is opposite to the axial direction of said primary fluid flow through said primary fluid annular passage.

6. A pump as in claim 1 wherein, (a) said primary fluid flow through said primary fluid annular passage is from said motor front to said motor back and (b) said secondary fluid flow through said secondary fluid annular passage is from said motor back to said motor front.

7. A pump as in claim 1 wherein, (a) means is provided in said primary fluid annular passage to direct fluid flow through said passage axially.

8. A pump as in claim 1 wherein, (a) a highly thermally conductive structure is provided in said primary fluid annular passage to direct said primary fluid flow through said primary fluid flow annular passage and conduct heat from said primary fluid to said secondary fluid flow annular passage.

9. A pump as in claim 1 wherein, (a) a highly thermally conductive structure is provided in said secondary fluid annular passage to direct said secondary fluid flow through said secondary fluid annular passage and conduct heat from said primary fluid flow annular passage to said secondary fluid flow.

10. A pump as in claim 1 wherein, (a) a highly thermally conductive structure is provided in said primary fluid annular passage to direct said primary fluid flow through said primary fluid flow annular passage and conduct heat from said primary fluid to said secondary fluid flow annular passage and (a) a highly thermally conductive structure is provided in said secondary fluid annular passage to direct said secondary fluid flow through said secondary fluid annular passage and conduct heat from said secondary fluid flow annular passage to said secondary fluid flow.

11. A motor driven centrifugal primary fluid pump for pumping cooling fluid to the electron beam tube of a CAT scan system comprising, (a) a pump rotor, (b) a pump drive motor having a motor drive shaft defining an axis of rotation, (c) a primary fluid sealed housing enclosing said rotor and said drive motor, (d) a primary fluid input to said primary housing from an outside source, (e) a primary fluid output from said primary housing to an outside utilization system, (f) said pump rotor being carried on said motor drive shaft so that said rotor rotates within said primary housing when driven by said motor drive shaft and pumps said primary fluid from said primary fluid input axially to said primary fluid output, (g) a secondary fluid sealed housing enclosing said primary fluid sealed housing, (h) a secondary fluid input to said secondary housing from a source of said secondary fluid, (i) a secondary fluid output from said secondary housing to a reservoir of said secondary fluid.

12. A pump as in claim 11 wherein, (a) said pump drive motor has a front and a back and a motor drive shaft at said motor front defining said axis of rotation and (b) said pump rotor is attached to said motor drive shaft at said motor front.

13. A pump as in claim 12 wherein, (a) said primary fluid input is at said pump rotor and (b) said primary fluid output is at said motor back.

14. A pump as in claim 13 wherein, (a) said secondary fluid input is at said motor back and (d) said secondary fluid output is at said motor front.

15. A pump as in claim 11 wherein, (a) the axial direction of said secondary fluid flow through said secondary fluid annular passage is opposite to the axial direction of said primary fluid flow through said primary fluid annular passage.

16. A pump as in claim 11 wherein, (a) said primary fluid flow through said primary fluid annular passage is from said motor front to said motor back and (b) said secondary fluid flow through said secondary fluid annular passage is from said motor back to said motor front.

17. A pump as in claim 11 wherein, (a) means is provided in said primary fluid annular passage to direct fluid flow through said passage axially.

18. A pump as in claim 11 wherein, (a) a highly thermally conductive structure is provided in said primary fluid annular passage to direct said primary fluid flow through said primary fluid flow annular passage and conduct heat from said primary fluid to said secondary fluid flow annular passage.

19. A pump as in claim 11 wherein, (a) a highly thermally conductive structure is provided in said secondary fluid annular passage to direct said secondary fluid flow through said secondary fluid annular passage and conduct heat from said primary fluid flow annular passage to said secondary fluid flow.

20. A pump as in claim 11 wherein, (a) a highly thermally conductive structure is provided in said primary fluid annular passage to direct said primary fluid flow through said primary fluid flow annular passage and conduct heat from said primary fluid to said secondary fluid flow annular passage and (a) a highly thermally conductive structure is provided in said secondary fluid annular passage to direct said secondary fluid flow through said secondary fluid annular passage and conduct heat from said secondary fluid flow annular passage to said secondary fluid flow.

21. A pump as in claim 11 wherein, (a) said pump rotor when driven by said motor drive shaft pumps said primary fluid from said primary fluid input to said primary fluid output accompanied by a thrust load on said motor, (b) a predetermined gap is maintained between said motor and said pump rotor and (c) means carried on said motor drive shaft for compelling some of said primary fluid inside said housing to flow with substantial velocity head through said gap, (d) whereby the static pressure of said primary fluid in said gap is substantially lower than the total pressure of said primary fluid in said gap and said thrust load is lowered.

22. A pump as in claim 21 wherein said means carried on said motor drive shaft for compelling some of said primary fluid inside said housing to flow with substantial velocity head through said gap includes:

(a) radial motor side fluid pumping vanes that project axially toward said motor and define radial motor fluid flow paths through said gap along which said fluid is compelled to flow away from said axis of rotation.

23. A pump as in claim 22 wherein, (a) said radial motor gap fluid flow paths along which said fluid is compelled to flow through said gap areaway from said axis of rotation are further defined by said motor front end.

24. A pump as in claim 23 wherein, (a) said radial motor gap fluid pumping vanes are carried on said pump rotor and (b) said radial motor gap fluid flow paths along which said motor fluid is compelled to flow away from said axis of rotation are further defined by said pump rotor.

25. A pump as in claim 24 wherein said pump rotor includes:

(a) a disc shaped pump rotor base fixedly attached to said motor drive shaft, coaxial with said drive shaft axis, (b) said pump rotor base having a front face that faces away from said motor front end and a rear face that faces said motor front end, (c) means on said base front face for compelling said fluid to flow from said fluid input to said fluid output and (d) said radial motor gap fluid pumping vanes are carried on said base rear face.

26. A pump as in claim 25 wherein, (a) said radial motor gap fluid flow paths along which said fluid is compelled to flow through said gap are away from said axis of rotation and are further defined by said pump rotor base rear face.

* * * * *